US008469583B1

(12) United States Patent
VanOsdol

(10) Patent No.: US 8,469,583 B1
(45) Date of Patent: Jun. 25, 2013

(54) RADIAL FLOW PULSE JET MIXER

(75) Inventor: John G. VanOsdol, Fairmont, WV (US)

(73) Assignee: U.S. Department of Energy, Washington, DC (US)

( * ) Notice: Subject to any disclaimer, the term of this patent is extended or adjusted under 35 U.S.C. 154(b) by 0 days.

(21) Appl. No.: 13/371,806

(22) Filed: Feb. 13, 2012

(51) Int. Cl.
*B01F 13/02* (2006.01)

(52) U.S. Cl.
USPC ..... 366/101; 366/106; 366/107

(58) Field of Classification Search
USPC ..... 366/347, 349, 138, 150.1, 340, 137.1, 366/136, 106, 101
See application file for complete search history.

(56) References Cited

U.S. PATENT DOCUMENTS

| | | | | |
|---|---|---|---|---|
| 128,234 | A * | 6/1872 | Matthews | 366/138 |
| 6,036,357 | A * | 3/2000 | Van Drie | 366/332 |
| 6,523,995 | B2 | 2/2003 | Fascano et al. | |
| 6,971,788 | B1 | 12/2005 | Gringer et al. | |
| 7,334,936 | B2 | 2/2008 | King | |

OTHER PUBLICATIONS

U.S. Department of Energy , DOE/EM-0447, "AEA Fluidic Pulse Jet Mixer," OST Reference #1511 (Aug. 1999).

* cited by examiner

*Primary Examiner* — Tony G Soohoo
*Assistant Examiner* — Anshu Bhatia
(74) *Attorney, Agent, or Firm* — James B. Potts; Mark P. Dvorscak; John T. Lucas

(57) ABSTRACT

The disclosure provides a pulse jet mixing vessel for mixing a plurality of solid particles. The pulse jet mixing vessel is comprised of a sludge basin, a flow surface surrounding the sludge basin, and a downcoming flow annulus between the flow surface and an inner shroud. The pulse jet mixing vessel is additionally comprised of an upper vessel pressurization volume in fluid communication with the downcoming flow annulus, and an inner shroud surge volume separated from the downcoming flow annulus by the inner shroud. When the solid particles are resting on the sludge basin and a fluid such as water is atop the particles and extending into the downcoming flow annulus and the inner shroud surge volume, mixing occurs by pressurization of the upper vessel pressurization volume, generating an inward radial flow over the flow surface and an upwash jet at the center of the sludge basin.

20 Claims, 6 Drawing Sheets

RADIAL FLOW PULSE JET MIXER

GOVERNMENT INTERESTS

The United States Government has rights in this invention pursuant to the employer-employee relationship of the Government to the inventors as U.S. Department of Energy employees and site-support contractors at the National Energy Technology Laboratory.

FIELD OF THE INVENTION

The disclosure relates to a pulse jet mixing vessel for mixing a plurality of solid particles. The pulse jet mixing vessel is comprised of a sludge basin, a flow surface surrounding the sludge basin, a downcoming flow annulus between the flow surface and an inner shroud. The pulse jet mixing vessel is additionally comprised of an upper vessel pressurization volume in fluid communication with the downcoming flow annulus, and an inner shroud surge volume separated from the downcoming flow annulus by the inner shroud. When the solid particles are resting on the sludge basin and a fluid such as water is atop the particles and extending into the downcoming flow annulus and the inner shroud surge volume, mixing may occur by pressurization of the upper vessel pressurization volume, generating an inward radial flow over the flow surface and an upwash jet at the center of the sludge basin.

BACKGROUND

Mixing processes are widely employed in unit operations intended to make heterogeneous physical systems more homogenous. A typical approach is the use of axial or radial impellors in agitated tanks for the mixing of fluids or slurries. These tanks utilize shear imparted to the fluid or slurry by the impellor to generate circulating flows within the tank. Typically the fluids or slurries mixed are non-hazardous materials, and draining and opening the tank to correct various issues arising with any moving parts inside the vessel is an acceptable method of repair.

When the mixing tanks are intended for the storage of relatively hazardous materials, such as radioactive waste awaiting remediation, draining and opening the tank becomes a significantly more complicated undertaking. However, mixing of the waste during storage remains a significant operational requirement, because typically the radioactive waste is made up of solid particles and liquids, and particles with high concentrations of fissile materials such as uranium or plutonium are dense, rapidly settling particles. In the absence of adequate mixing during storage, the rapidly settling particles can settle preferentially and accumulate, creating a potential for inadvertent criticality in the sediment. Additionally, the sediment layers can retain significant quantities of flammable gas generated from radiolysis, which, without adequate mixing, may be released suddenly through a spontaneous buoyant displacement gas release event and potentially exceed the lower flammability limit in the mixing vessel headspace.

Due to the requirement for periodic mixing, combined with the logistical difficulties of opening a radioactive waste tank for repair, it is generally desired that radioactive storage tanks provide a mixing capability with an absence of any moving parts within the tank itself. To meet these requirements, fluidic pulse jet mixers (PJM) are commonly employed. PJM's employ pulse jets formed by alternating pressure and suction on fluid in pulse tubes coupled to jet nozzles, creating a pulsating flow. The nozzle end of the tube is immersed in the tank, while periodic pressure, vacuum, and venting are supplied to the opposite end. A suction phase draws process liquid into the PJM from the vessel, and a drive phase subsequently pressurizes the PJM with compressed air. This pressurization discharges the PJM liquid at high velocity into the vessel, causing mixing to occur. The drive phase is followed by a vent phase, which allows for depressurization of the PJM. These three phases (suction, drive, and vent) make up the mixing cycle. Such a system is intended to provide a motive mixing force within the tank without reliance on moving parts within the tank environment.

Pulse jet mixers as described are commonly used, however certain undesired characteristics remain. Generally speaking, during the drive phase, flow from the jet moves radially away from the jet into the waste sediment, the flow velocity decreases, and the drag force per particle decreases with the increasing radius. This entrains new particles, however the slowing particles subject to the decreasing flow velocity are not removed from the flow, and the particles bunch together, so that multiple particles form large masses of particles. These large masses effectively act as a very large particle. The time constant for the large masses is long, and clumping and cratering within the waste sediment results. In the limiting case, acceleration of mass goes to zero and PJM energy is totally dissipated by the formation of stable crater walls. These dead zones are an undesired situation with regard to radioactive wastes for the reasons discussed above. PJMs typically expend significant energy ensuring that limiting cases are avoided.

Particle clumping is a natural consequence of decelerating multiphase flows, where fluid motion is relatively fast, particles are pushed, and the resulting particle motion is relatively slow. It would be advantageous to provide a pulse jet mixing vessel where mixing of solids could occur within the vessel without attendant moving parts, and where the mixing could occur through an accelerating, radial inward flow over a bed of particles. Such a flow would tend to pull particles into a central upwash jet and into the body of the fluid, greatly mitigating or eliminating the formation of sediment craters and any associated dead zones. It would be particularly advantageous if the pulse jet mixing vessel produced the inward radial flow in a manner which eliminates dissipative and unnecessary secondary flows, so that acceleration of inward radial flow over the leading edge and the bulk of the sediment would reduce fluid/solid shear transport mechanisms, greatly reduce the production of turbulent dissipation, enhance wake formation at the trailing edge, and enhance the transport mechanism of the central upwash fountain.

These and other objects, aspects, and advantages of the present disclosure will become better understood with reference to the accompanying description and claims.

SUMMARY

The disclosure provides a pulse jet mixing vessel designed to promote the mixing of solid particles contained in a sludge basin. In operation, a liquid such as water is additionally held by the sludge basin, with a water level above and permeating through the particle bed. The pulse jet mixing vessel achieves particle mixing by periodically generating an inward radial flow from around the outer periphery of the sludge basin and radially inwards toward the center of the sludge basin.

During the inward radial flow, radial stream lines converge inwardly across the sludge basin outer periphery, accelerating as the center is approached and forming an upwash jet. As the flow moves across the trailing edge of the sludge pile and into the upwash jet, turbulent diffusion is greatly enhanced, and particles in the particle bed generally around the mixing vessel axis are pulled from the bed into the upwash jet. Concurrently, shear forces between the inward radial flow and the particles bed shift remaining particles toward the mixing vessel axis. When the inward radial flow ceases, the particles settle by gravity back onto the sludge basin.

The pulse jet mixing vessel is comprised of a sludge basin having a sludge basin surface intersected by a longitudinal mixing vessel axis L. In operation, longitudinal mixing vessel axis L is substantially parallel to a gravity vector, and the particles are held against the sludge basin surface by gravity. The pulse jet mixing vessel is further comprised of a flow surface in contact with the sludge basin surface around a sludge basin outer periphery, and in contact with an upper vessel surface around an upper vessel periphery. The sludge basin outer periphery and the upper vessel periphery are closed curves residing in a plane perpendicular to longitudinal mixing vessel axis L. Preferably the closed curves are elliptical or circular. The pulse jet mixing vessel is further comprised of a flow shroud having a concavity toward the sludge basin.

The pulse jet mixing vessel is further comprised of a downcoming flow annulus bounded in part by the flow surface and an outer surface of the flow shroud. The downcoming flow annulus is in fluid communication with an upper vessel pressurization volume, bounded in part by the upper vessel surface. An inner shroud surge volume is bounded in part by the inner surface of the flow shroud. The flow shroud is spatially arranged to such that a straight line between any point in the upper vessel pressurization volume and any point in the inner shroud surge volume passes through the flow shroud.

An upper vessel gas conduit is in fluid communication with the upper vessel pressurization volume, and an inner shroud gas conduit is in fluid communication with the inner shroud surge volume. In operation, the pulse jet mixing vessel contains a liquid such as water body covering and permeating a particle bed on the sludge basin, and extending into the downcoming flow annulus and the inner shroud surge volume. During a mixing cycle, the upper vessel pressurization volume is pressurized by some means such as the upper vessel gas conduit, expelling water from the downcoming flow annulus and driving water into the inner shroud surge volume. The water expelled from the downcoming flow annulus generates an inward radial flow over the particle bed, and turns into an upwash jet generally along longitudinal mixing vessel axis L. Following pressurization, particles lifted into the liquid volume of the water body settle by gravity back to the sludge basin surface.

Embodiments of the pulse jet mixing vessel and the necessary spatial relationships between components are further demonstrated and described in the following description.

DETAILED DESCRIPTION

The following description is provided to enable any person skilled in the art to use the invention and sets forth the best mode contemplated by the inventor for carrying out the invention. Various modifications, however, will remain readily apparent to those skilled in the art, since the principles of the present invention are defined herein to provide a pulse jet mixing vessel having a sludge basin, where the pulse jet mixing vessel generates an inward radial flow and a central upwash jet over the sludge basin, providing for the mixing of a plurality of solid particles with an absence of moving parts within the vessel. The pulse jet mixing vessel disclosed has particular applicability to the mixing of heavy particulates in a fluid, such as nuclear waste material existing as solid particulate matter and contained in large water filled vessels.

The pulse jet mixing vessel disclosed is designed to promote the mixing of solid particles contained in a sludge basin. The sludge basin preferably has an elliptical, more preferably circular, outer periphery centered around a mixing vessel axis, and in the absence of a mixing flow, the solid particles form a bed resting in the sludge basin. In operation, a liquid such as water is additionally held by the sludge basin, with a water level above and permeating through the particle bed. In operation, the pulse jet mixing vessel achieves particle mixing by periodically generating an inward radial flow from around the outer periphery of the sludge basin and radially inwards toward the center of the sludge basin.

During the inward radial flow, radial stream lines converge inwardly across the sludge basin outer periphery. The radial stream lines flow over the top of the particle bed and toward the center of the sludge basin, accelerating as the center is approached. The inward radial streamlines subsequently converge at the center of the sludge basin and turn into an upwash jet, flowing generally upward along the mixing vessel axis. As the flow turns, turbulent diffusion is greatly enhanced at the trailing edge of the sludge pile, and particles in the particle bed generally around the mixing vessel axis are pulled from the bed into the upwash jet. Concurrently, shear forces between the inward radial flow and the particles bed shift remaining particles toward the mixing vessel axis. In this manner, particles in the particle bed are pulled into the upwash jet and carried into the water covering the particle bed, and evolved gases in the particle bed are liberated. When the inward radial flow ceases, the particles settle by gravity back onto the sludge basin and the evolved gases may separate due to buoyancy. This mixing cycle greatly mitigates any particle agglomeration or the buildup of any gases evolved in the particle bed.

Figure 1B:
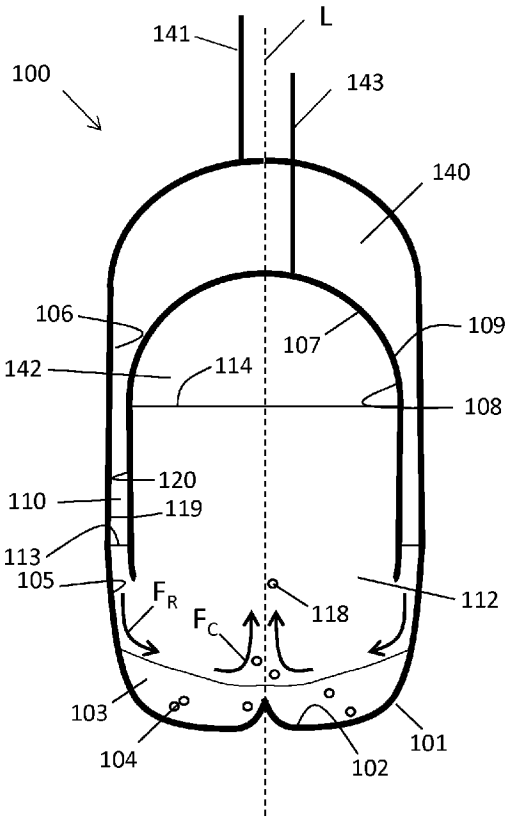
FIG. 1B illustrates an embodiment of the pulse jet mixing vessel containing a plurality of solid particles and a body of water with the upper vessel pressurization volume in a pressurized condition.
Figure 1A:
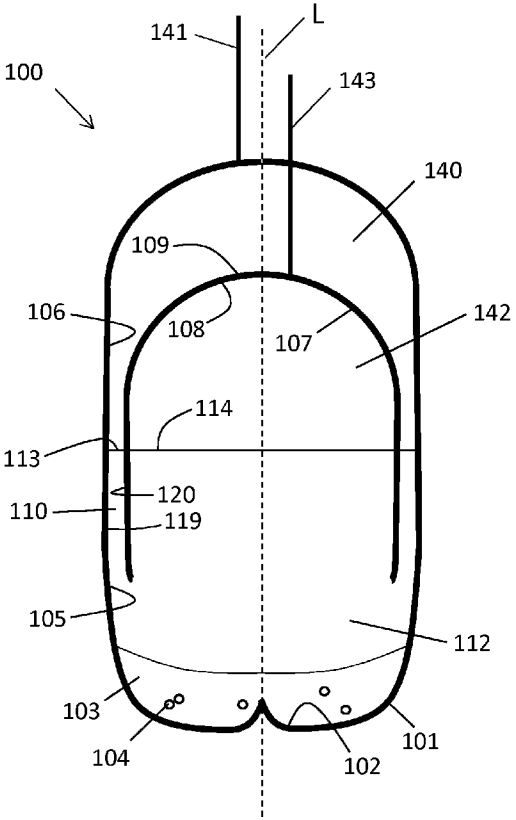
FIG. 1A illustrates an embodiment of the pulse jet mixing vessel containing a plurality of solid particles and a body of water with the upper vessel pressurization volume in a depressurized condition.

A basic embodiment of the pulse jet mixing vessel indicated generally at 100 is illustrated at FIGS. 1A and 1B. Pulse jet mixing vessel 100 has a longitudinal mixing vessel axis L, and FIGS. 1A and 1B represents a cross-section of pulse jet mixing vessel 100 based on a cutting plane co-planer with longitudinal mixing vessel axis L.

Pulse jet mixing vessel 100 is comprised of sludge basin 101 having sludge basin surface 102, and in operation contains particle bed 103 comprised of a plurality of solid particles, such as particle 104. In the embodiment shown, longitudinal mixing vessel axis L is substantially parallel to a gravity vector, and the particle bed 103 is held against sludge basin surface 102 by gravity. Pulse jet mixing vessel 100 is further comprised of a flow surface 105, upper vessel surface 106, and flow shroud 107. Flow surface 105 is in contact with sludge basin surface 102 around a sludge basin outer periphery and in contact with upper vessel surface 106 around an upper vessel periphery, where the sludge basin outer periphery and the upper vessel periphery are closed curves residing in a plane perpendicular to longitudinal mixing vessel axis L. Flow shroud 107 is comprised of inner shroud surface 108 and outer shroud surface 109, as illustrated.

Pulse jet mixing vessel 100 is further comprised of downcoming flow annulus 110, upper vessel pressurization volume 140, and inner shroud surge volume 142. Downcoming flow annulus 110 is bounded in part by flow surface 105 and outer shroud surface 109. Upper vessel pressurization volume 140 is bounded in part by upper vessel surface 106 and outer shroud surface 109. Inner shroud surge volume 142 is bounded in part inner shroud surface 108. The inner and outer surfaces of flow shroud 107 are spatially arranged such that a straight line between any point in upper vessel pressurization volume 140 and any point in inner shroud surge volume 142 passes through flow shroud 107, as discussed infra. Additionally, upper vessel gas conduit 141 is in fluid communication with upper vessel pressurization volume 140 through an upper vessel flow opening, and inner shroud gas conduit 143 is in fluid communication with inner shroud surge volume 142 through an outer shroud flow opening and an inner shroud flow opening.

In operation, pulse jet mixing vessel 100 contains a liquid such as water body 112 covering and permeating particle bed 103 and extending into downcoming flow annulus 110 and inner shroud surge volume 142, as illustrated at FIG. 1A. At FIG. 1A, water body 112 is in equilibrium and water surface 113 in downcoming flow annulus 110 is level with water surface 114 inside inner shroud surge volume 142. During a mixing cycle, pulse jet mixing vessel 100 disrupts the equilibrium and generates an inward radial flow around the outer periphery of sludge basin 101 by pressurizing upper vessel pressurization volume 140 through upper vessel gas conduit 141 while venting inner shroud surge volume 142 through inner shroud gas conduit 143. Alternatively, pulse jet mixing vessel 100 generates the inward radial flow with an initial suction phase, through application of a vacuum to upper vessel pressurization volume 140 in order to draw water surface 113 toward upper vessel pressurization volume 140 in downcoming flow annulus 110, followed by vacuum relaxation and an inward radial flow resulting from a positive head differential between water surface 113 and water surface 114.

FIG. 1B illustrates pulse jet mixing vessel 100 with upper vessel pressurization volume 140 pressurized through upper vessel gas conduit 141 while inner shroud surge volume 142 is vented through inner shroud gas conduit 117. With water body 112 extending into downcoming flow annulus 110 and inner shroud surge volume 142, this action expels water from downcoming flow annulus 110 and drives water into inner shroud surge volume 142, as illustrated at FIG. 1B. The water expelled from downcoming flow annulus 110 generates an inward radial flow $F_R$ over flow surface 105 and particle bed 103. The inward radial nature of the flow generates an accelerating flow over particle bed 103 as the flow streamlines approach longitudinal mixing vessel axis L, and as the accelerating flow over particle bed 103 converges to the vicinity of longitudinal mixing vessel axis L, the converging flow turns into an upwash jet $F_C$ generally along longitudinal mixing vessel axis L.

The generated flows result in a situation where the radial flow $F_R$ generates reduced turbulent diffusion in the flow as compared to the turning upwash jet flow $F_C$. As a result, particles in particle bed 103 and subject to the radial flow $F_R$ experience reduced hydrodynamic forces as compared to particles subject to the turning upwash jet flow $F_C$, and particles subject to the upwash jet flow $F_C$ are significantly more likely to be pulled into the flow. As a result, particles in the vicinity of the upwash jet such as particle 118 are pulled from particle bed 103 and transported into the liquid volume of water body 112. Concurrently, particles subject to radial flow $F_R$, while significantly less likely to be pulled from particle bed 103 into the flow, experience shear forces with radial flow $F_R$ and are driven toward longitudinal mixing vessel axis L, and toward the vicinity of the upwash jet. With sufficient pressurization of upper vessel pressurization volume 140, sufficient water inventory, and sufficient capacity of inner shroud surge volume 142, among other factors, radial flow $F_R$ and the expanding upwash jet flow $F_C$ may lift substantially all the particles comprising particle bed 103 into the liquid volume of water body 112.

It is understood that the inward radial flow $F_R$ represents a flow velocity from the sludge basin outer periphery toward the longitudinal mixing vessel axis L. As a result, the inward radial flow $F_R$ may arise as a component of a flow having swirl in a plane perpendicular to the longitudinal mixing vessel axis L. Guidevanes may be implemented in downcoming flow annulus 110, sludge basin surface 102, or other components in contact with water body 112 in order to either encourage or counter the swirl.

Following pressurization, upper vessel pressurization volume 140 and inner shroud surge volume 142 may be vented through upper vessel gas conduit 141 and inner shroud gas conduit 143 respectively to restore water surfaces 113 and 114 to equilibrium levels. Similarly, particles lifted into the liquid volume of water body 112 are expected to settle by gravity back to sludge basin surface 102 and reform particle bed 103. Periodic re-suspension and settling in this manner significantly mitigates any tendencies toward particle agglomeration and gas trapping which might occur in an unmixed particle bed. Further, pulse jet mixing vessel 100 accomplishes this mixing through the mechanical relationship of static internal components, greatly reducing any requirements to open the vessel over an operating period. The latter advantage may be particularly significant when periodic mixing of hazardous particles is required. For example, when periodic mixing of nuclear waste material of significantly varying particle size and weight is desired.

DESCRIPTION OF A SPECIFIC EMBODIMENT

The spatial relationships between selected components comprising the pulse jet mixing vessel of this disclosure is described with the aid of geometric entities. Within this disclosure, the term "geometric" when applied to a line, plane, and the like is intended to signify that the line or plane has idealized geometric properties following the Euclidean definitions. Further, the term "line" means a straight line. See e.g., M. Solomonovich. *Euclidean Geometry: A First Course*. New York: iUniverse, 2010, among others. Correspondingly, a "geometric line," "geometric plane," and the like means the line or plane is not a physical component of the pulse jet mixing apparatus, but rather is invoked merely to define spatial and other relationships between the physical components. Further, the term "curve" as used herein means a two-dimensional plane curve having spatial properties such that when a plane passes through three points of the curve, it passes through all the other points of the curve, and includes curves which may be substantially described as a straight line, or a series of straight lines, or which may be comprised of straight lines.

The relationship between selected components comprising the pulse jet mixing vessel further described with reference to a cross-section of the pulse jet mixing vessel generated by a cutting plane $C_1$ bounded by longitudinal mixing vessel axis L, where longitudinal mixing vessel axis L is a geometric line. The cutting plane $C_1$ is a geometric two-dimensional closed half-plane having the longitudinal mixing vessel axis L as its single defined boundary, and consists of all coplanar points on one side of longitudinal mixing vessel axis L and all points intersected by longitudinal mixing vessel axis L, and no other points. Additionally, within this disclosure, an x-y-z coordinate system is utilized where the origin of the coordinate system is at a first point, discussed infra, and where the y-axis of the x-y-z coordinate system is collinear with longitudinal mixing vessel axis L. The cutting plane $C_1$ is co-planer with the x-y plane of the x-y-z coordinate system defined. Within this disclosure, the x-y-z coordinate system may be established in any orientation with respect to the pulse jet mixing vessel, provided that the origin of the x-y-z coordinate system is at the first point, and provided that the y-axis of the x-y-z coordinate system is collinear with the longitudinal mixing vessel axis L.

Figure 7:
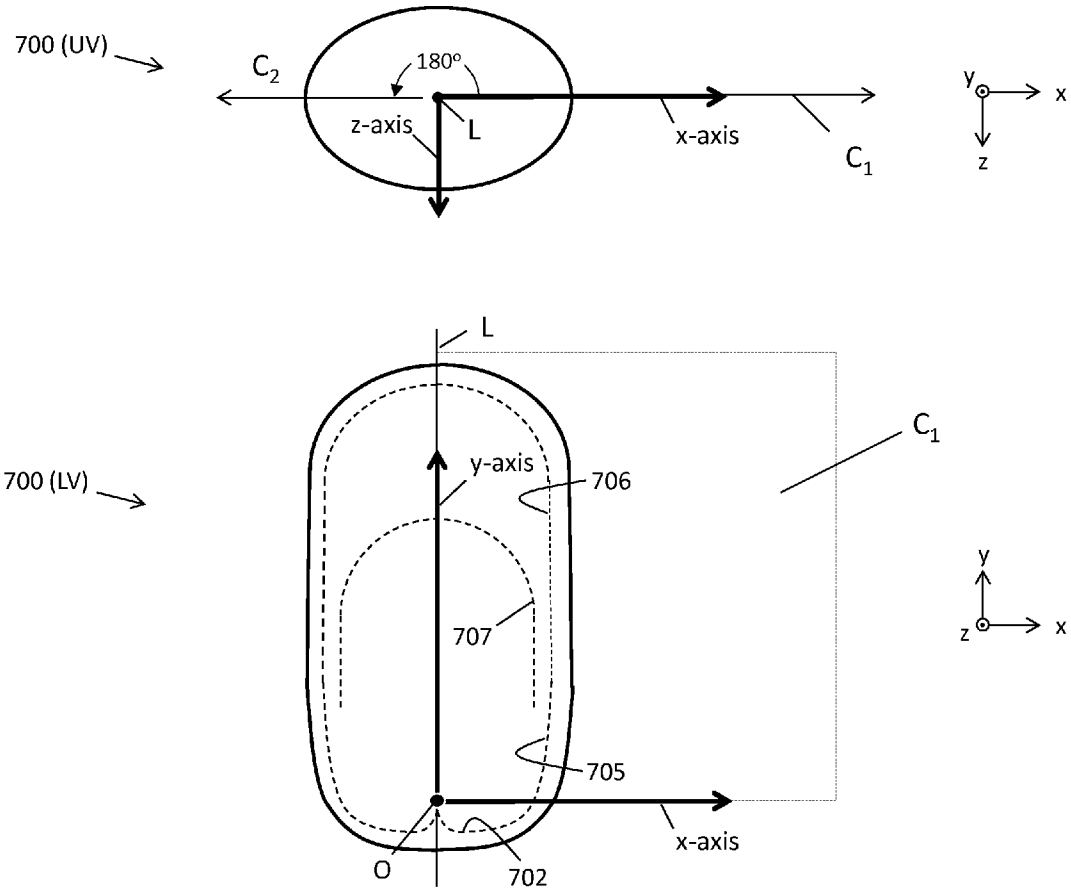
FIG. 7 illustrates and upper view and a lower view of a specific embodiment of the pulse jet mixing vessel.

As an example, FIG. 7 illustrates an upper and lower view of an embodiment of the pulse jet mixing vessel, where the upper view is delineated as 700 (UV) and the lower view is delineated as 700 (LV). Upper view 700 (UV) and lower view 700 (LV) are rotated 90 degrees with respect to each other, as indicated by the associated coordinate directions shown. Additionally, the viewpoints are external to the pulse jet mixing vessel, however for reference the lower view 700 (LV) also illustrates hidden lines within this embodiment, showing sludge basin surface 702, flow surface 705, upper vessel surface 706, and flow shroud 707. Longitudinal mixing vessel axis L is a geometric line in the lower view 700 (LV) and correspondingly illustrated as a point in the upper view 700 (UV).

At FIG. 7, an x-axis, a y-axis, and a z-axis originate at an origin O. The origin O corresponds to a first point, where the first point is a specific point on sludge basin surface 702, as will be discussed infra. The x-axis, the y-axis, and the z-axis form a right-hand coordinate system, where the y-axis is collinear with longitudinal mixing vessel axis L, and cutting plane $C_1$ is a geometric two-dimensional closed half-plane having the longitudinal mixing vessel axis L as its single defined boundary, and co-planer with the x-y plane, as earlier defined. Correspondingly, the cutting plane $C_1$ is illustrated in the upper view 700 (UV) as a geometric ray coincident with the x-axis and extending from longitudinal mixing vessel axis L. Additionally, some spatial relationships are described with reference to a second cutting plane $C_2$, where the second cutting plane $C_2$ is an open half-plane in the x-y plane and having longitudinal mixing vessel axis L as a boundary, and which is displaced from cutting plane $C_1$ by an angle of 180° (180 degrees) in the x-z plane, as illustrated.

Figure 2:
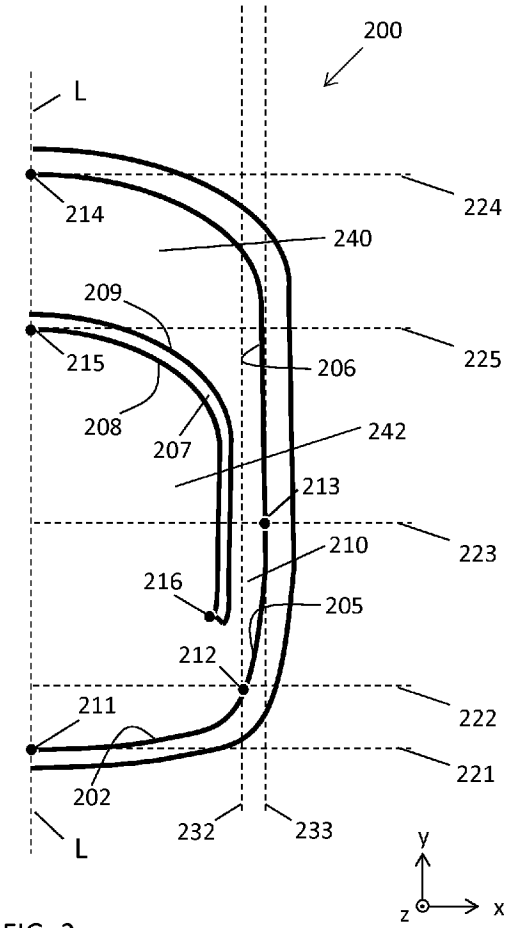
FIG. 2 illustrates spatial relationships between components comprising an embodiment of the pulse jet mixing vessel.

The relationship between selected components comprising the pulse jet mixing vessel is further described with reference to FIG. 2. FIG. 2 represents a cross-section of pulse jet mixing vessel 200 based on a cutting plane $C_1$ (not shown), as earlier defined. Additionally, as earlier defined, a first point 211 defines an origin for an x-axis and a y-axis, where the y-axis is collinear with longitudinal mixing vessel axis L. The x-axis and y-axis are not shown at FIG. 2, however, for reference, an x-y-z directional axis is indicated. As earlier defined, the cutting plane $C_1$ is co-planer with the x-z plane.

At FIG. 2, pulse jet mixing vessel 200 is comprised of sludge basin surface 202, similarly represented by the cross-section resulting from cutting plane $C_1$. Sludge basin surface 202 has spatial properties such that an intersection between sludge basin surface 202 and the cutting plane $C_1$ generates a sludge basin plane curve in the cutting plane $C_1$, where the sludge basin curve originates at the first point 211 located on longitudinal mixing vessel axis L and extends to a second point 212 on the sludge basin outer periphery. First point 211 additionally defines a first point perpendicular 221, where first point perpendicular 221 is a geometric line perpendicular to longitudinal mixing vessel axis L and passing through first point 211. Second point 212 additionally defines a second point perpendicular 222 and a second point parallel 232, where second point perpendicular 222 is a geometric line perpendicular to longitudinal mixing vessel axis L and passing through second point 212, and where second point parallel is a geometric line parallel to mixing vessel axis L and passing through second point 212.

In an embodiment, the sludge basin curve resulting from the intersection between sludge basin surface 202 and cutting plane $C_1$ can be substantially described by a first mathematical function from first point 211 to second point 212, where the first mathematical function may be a piece-wise mathematical function. The first mathematical function has a variable x and a variable y, where the variable x describes points on the x-axis and where the variable y describes points on the y-axis, and where the first mathematical function treats the variable x as an independent variable and the variable y as a dependent variable, such that the first mathematical function assigns one dependent variable y to each independent variable x. In an embodiment, the first mathematical function has a defined first derivative of the variable x with respect to the variable y from first point 211 to second point 212. In another embodiment, the first mathematical function does not have a point of inflection from first point 211 to second point 212.

Within this disclosure, the terms "substantially described," "substantially describes," and the like, when applied to a mathematical function describing a generated curve formed by the intersection between a given surface and the cutting plane $C_1$, is intended to mean that the mathematical function describes the generated curve as an intended article of manufacture, and that the mathematical function is not invalidated by the presence of incidental surface variations incurred as an unintended result of a manufacturing process. For example, if a sludge basin curve is substantially described by a first mathematical function assigning one dependent first variable y to each independent first variable x as an intended article of manufacture, and the subsequently fabricated sludge basin generates a fabricated sludge basin curve which includes incidental surface variations that arise as a result of casting, polishing, grinding, or another fabrication processes, and one or more of the incidental surface variations results in the fabricated sludge basin curve departing from the strict mathematical definition of the first mathematical function, a first mathematical function which "substantially describes" the sludge basin curve includes those incidental departures present in the fabricated sludge basin curve.

It is understood that the sludge basin surface as described may be penetrated by operational flow conduits or openings in fluid or other communication with the interior of the pulse jet mixing vessel in order to satisfy additional operational necessities. For example, the sludge basin surface or other surface may be comprised of a sludge inlet/outlet flow conduit in fluid communication with the interior of the pulse jet mixing vessel, in order to provide a pathway through which sludge and sediment may be inserted into or extracted from the pulse jet mixing vessel. As a result, when the cutting plane $C_1$ has an orientation with respect to longitudinal mixing vessel axis L such that cutting plane $C_1$ passes through a region where an operational flow conduit or opening penetrates the sludge basin surface, a portion of the resulting sludge basin curve will be comprised of a flow section. For example, at FIG. 3, a sludge basin surface 302 is penetrated by an operational flow conduit 348, intended to serve as a sludge inlet/outlet flow conduit. A cutting plane $C_1$ (not shown) in the x-y plane has an orientation such the cutting plane $C_1$ passes through operational flow conduit 348. As before, a sludge basin curve originates at first point 311 on longitudinal mixing vessel axis L and extends to second point 312. However, the sludge basin curve from first point 311 to second point 312 consists of a first section from first point 311 to contact point $P_1$, a flow section 347 from contact point $P_1$ to contact point $P_2$, and a third section from contact point $P_2$ to second point 312. The contact points $P_1$ and $P_2$ are points on sludge basin surface 302 in contact with operational flow conduit 348, where operational flow conduit 348 penetrates sludge basin surface 302. The sludge basin curve from first point 311 to second point 312 is thus comprised of flow section 347, where flow section 347 is a geometric line segment between contact points $P_1$ and $P_2$ and having $P_1$ and $P_2$ as endpoints.

Within this disclosure, a "flow section" means a geometric line segment from a first contact point to a second contact point and having the first contact point and the second contact point as endpoints, where the first contact point and the second contact points are points on a surface and in contact with an operational flow conduit or opening penetrating the surface, and where the first contact point and the second contact point are intersected by a cutting plane $C_1$, where the cutting plane $C_1$ further and necessarily intersects the operational flow conduit or opening. Within this disclosure, when a surface such as the sludge basin surface is penetrated by an operational flow conduit or opening, and a cutting plane $C_1$ has an orientation such that the cutting plane $C_1$ intersects the operational flow opening or conduit, such that first and second contact points arise as defined, and such that a flow section exists as defined, then the resulting curve generated by an intersection between the cutting plane $C_1$ and the surface is comprised of the flow section.

As is understood, flow sections arising from a given operational flow conduit or opening penetrating a surface of the pulse jet mixing vessel may be parameterized and integrated to give a flow opening surface area. Typically the flow opening surface area will be significantly less than the total surface area of the penetrated surface. For example, in an embodiment, the total of all flow opening surface areas in the sludge basin surface is less than about 10% of the total surface area of the sludge basin surface.

Figure 4:
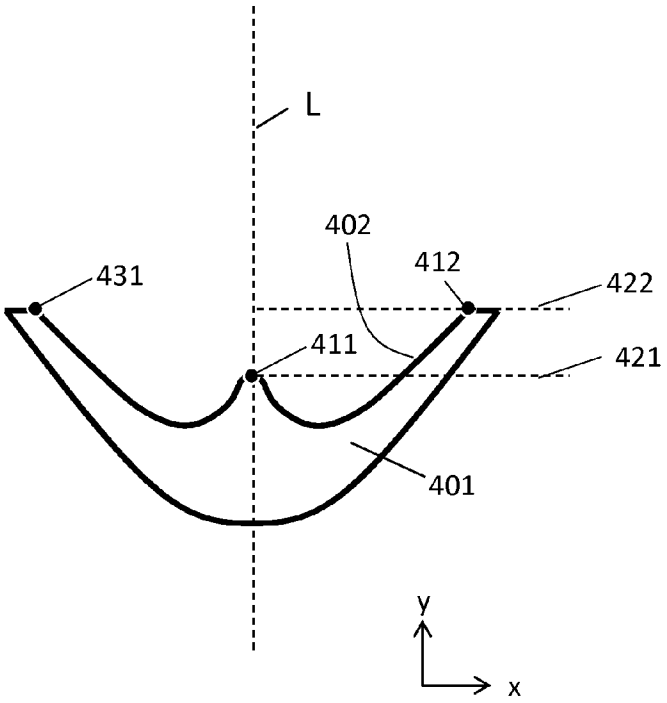
FIG. 4 illustrates a sludge basin in a specific embodiment of the pulse jet mixing vessel.

In an embodiment, longitudinal mixing vessel axis L is a line of symmetry with respect to the sludge basin curve, except for cutting plane $C_1$ orientations where the cutting plane $C_1$ intersects a penetrating operational flow conduit or opening and the resulting flow sections are not reflected across the longitudinal mixing vessel axis L. When the longitudinal mixing vessel axis L is a line of symmetry, and second cutting plane $C_2$ intersects the sludge basin surface, where second cutting plane $C_2$ is as earlier defined, the intersection of the second cutting plane $C_2$ and the sludge basin surface is substantially described by a reflected first mathematical function in the second cutting plane $C_2$. The reflected first mathematical function thus substantially describes a second sludge basin curve in the second cutting plane $C_2$, where the second sludge basin curve is a mirror image of the sludge basin curve with respect to longitudinal mixing vessel axis L. For example, FIG. 4, depicts a cross-section view of a sludge basin 401 generated by the cutting plane $C_1$ (not shown) defined earlier, where a sludge basin curve extends from first point 411 to second point 412 and results from the intersection of sludge basin surface 402 and cutting plane $C_1$. At FIG. 4, longitudinal mixing vessel axis L is a line of symmetry, and the second cutting plane $C_2$ (not shown) intersects sludge basin surface 402 and generates the second sludge basin curve extending from first point 411 to mirror point 431. The reflected first mathematical function from first point 411 to mirror point 431 is a reflection of the first mathematical function from first point 411 to second point 412 with respect to longitudinal mixing vessel axis L, and the second sludge basin curve in the second cutting plane $C_2$ is substantially a mirror image of the sludge basin curve in the cutting plane $C_1$.

In a further embodiment, the first mathematical function substantially describes a generatrix of sludge basin surface 202 for all cutting plane $C_1$ orientations except those orientations where cutting plane $C_1$ intersects a penetrating operational flow conduit or opening, and sludge basin surface 202 is a surface of revolution about longitudinal mixing vessel axis L for all areas of the sludge basin surface except those areas where the sludge basin curve includes a flow section. In another embodiment, the sludge basin surface and the annulus may be baffled to assist, in directing an inward radial flow toward longitudinal mixing vessel axis L, or a similar reason.

Pulse jet mixing vessel 200 is further comprised of flow surface 205, similarly represented by the cross-section resulting from cutting plane $C_1$. Flow surface 205 has spatial properties such that an intersection between flow surface 205 and the cutting plane $C_1$ generates a flow surface curve in the cutting plane $C_1$, where the flow surface curve originates at the second point 212 and extends to a third point 213 on the upper vessel periphery. Third point 213 additionally defines a third point perpendicular 223 and a third point parallel 233, where third point perpendicular 223 is a geometric line perpendicular to longitudinal mixing vessel axis L and passing through third point 213, and where third point parallel 233 is a geometric line parallel to mixing vessel axis L and passing through third point 213. Third point 213 is located such that second point parallel 232 is between third point parallel and mixing vessel axis L, and further located such that either second point perpendicular 222 is located between third point perpendicular 223 and first point perpendicular 221, or first point perpendicular 221 is located between third point perpendicular 223 and second point perpendicular 222.

In an embodiment, the flow surface curve resulting from the intersection between flow surface 205 and cutting plane $C_1$ can be substantially described by a second mathematical function from second point 212 to third point 213, where the second mathematical function may be a piece-wise mathematical function. The second mathematical function has the variable x and the variable y, and the second mathematical function treats the variable y as an independent variable and the variable x as a dependent variable, such that the second mathematical function assigns one dependent variable x to each independent variable y. In an embodiment, all values of the dependent variable x generated by the second mathematical function are greater than or equal to a value of x where the second point parallel 232 intersects the x-axis. In another embodiment, the second mathematical function has a defined first derivative of the variable y with respect to the variable x from second point 212 to third point 213. In another embodiment, the second mathematical function does not have a point of inflection from second point 212 to third point 213.

Similar to the sludge basin surface, the flow surface may be penetrated by operational flow conduits or openings in fluid or other communication with the interior of the pulse jet mixing vessel. When a cutting plane $C_1$ has an orientation with respect to longitudinal mixing vessel axis L such that the cutting plane $C_1$ passes through a region where an operational flow conduit or opening penetrates the flow surface, a portion of the resulting flow surface curve will be comprised of a flow section extended between two contact points, where the contact points are intersected by the cutting plane $C_1$ and where the cutting plane $C_1$ further and necessarily intersects the operational flow conduit or opening, as earlier discussed. Typically the flow opening surface area of all operational flow conduits or openings penetrating the flow surface will be significantly less than the total surface area of the flow surface. In an embodiment, the flow opening surface area of all operational flow conduits or openings penetrating the flow surface is less than about 10% of the total surface area of the flow surface.

In an embodiment, longitudinal mixing vessel axis L is a line of symmetry with respect to the flow surface sludge basin curve, except for cutting plane $C_1$ orientations where the cutting plane $C_1$ intersects a penetrating operational flow conduit or opening, and the resulting flow sections are not reflected across the longitudinal mixing vessel axis L. In this embodiment, a second flow surface curve generated by an intersection between the flow surface and the second cutting plane $C_2$ defined earlier is substantially described by a reflected second, mathematical function in the second cutting plane $C_2$, such that the reflected second mathematical function is a reflection of the second mathematical function with respect to longitudinal mixing vessel axis L. In a further embodiment, the second mathematical function substantially describes a generatrix of flow surface 205 for all cutting plane $C_1$ orientations except those orientations where cutting plane $C_1$ intersects a penetrating operational flow conduit or opening, and flow surface 205 is a surface of revolution about longitudinal mixing vessel axis L for all areas of flow surface 205 except those areas where the flow surface curve includes a flow section.

Pulse jet mixing vessel 200 is further comprised of upper vessel surface 206, similarly represented by the cross-section resulting from cutting plane $C_1$. Upper vessel surface 206 has spatial properties such that an intersection between upper vessel surface 206 and the cutting plane $C_1$ generates an upper vessel curve in the cutting plane $C_1$, where the upper vessel curve originates at the third point 213 and extends to a fourth point 214 on longitudinal mixing vessel axis L. Fourth point 214 additionally defines a fourth point perpendicular 224, where fourth point perpendicular 224 is a geometric line perpendicular to longitudinal mixing vessel axis L and passing through fourth point 214. Fourth point 214 is located such that third point perpendicular 223 is between fourth point perpendicular 224 and second point perpendicular 222. Additionally, the upper vessel curve does not intersect longitudinal mixing vessel axis L between third point 213 and fourth point 214.

Similar to the sludge basin curve, when a cutting plane $C_1$ has an orientation with respect to longitudinal mixing vessel axis L such that the cutting plane $C_1$ passes through an operational flow conduit or opening penetrating the upper vessel surface, a portion of the resulting upper vessel curve will be comprised of a flow section extended between two contact points, as earlier discussed. As will be explained, the upper vessel surface is penetrated by at least an upper vessel flow opening, where the upper vessel flow opening is an operational flow conduit or opening in fluid communication with an upper vessel gas conduit. Typically the flow opening surface area of all operational flow conduits or openings penetrating the upper vessel surface will be significantly less than the total surface area of the upper vessel surface. In an embodiment, the flow opening surface area of all operational flow conduits or openings penetrating the upper vessel surface is less than 5% of the total surface area of the upper vessel surface.

Pulse jet mixing vessel 200 is further comprised of flow shroud 207, which is comprised of inner shroud surface 208 and outer shroud surface 209. Flow shroud 207, inner shroud surface 208, and outer shroud surface 209 are similarly represented by the cross-section resulting from cutting plane $C_1$. Inner shroud surface 208 has spatial properties such that an intersection between inner shroud surface 208 and the cutting plane $C_1$ generates an inner shroud curve in the cutting plane $C_1$, where the inner shroud curve originates at a fifth point 215 and extends to a sixth point 216, where the fifth point 215 is on longitudinal mixing vessel axis L. Fifth point 215 additionally defines a fifth point perpendicular 225, where fifth point perpendicular 225 is a geometric line perpendicular to longitudinal mixing vessel axis L and passing through fifth point 215. Fifth point 215 is located such that fifth point perpendicular 225 is between fourth point perpendicular 224 and third point perpendicular 223. Additionally, the inner shroud curve does not intersect longitudinal mixing vessel axis L at any points, with the exception of fifth point 215. Further, sixth point 216 is located between third point perpendicular 223 and second point perpendicular 222, and between third point parallel 233 and longitudinal mixing vessel axis L. Additionally, the inner shroud curve does not intersect the upper vessel curve at any points.

Similar to the sludge basin curve, when a cutting plane $C_1$ has an orientation with respect to longitudinal mixing vessel axis L such that the cutting plane $C_1$ passes through an operational flow conduit or opening penetrating the inner shroud surface, a portion of the resulting inner shroud curve will be comprised of a flow section extended between two contact points, as earlier discussed. In an embodiment, and similar to the upper vessel surface, the inner shroud surface is penetrated by at least an inner shroud flow opening, as will be discussed, and may be penetrated by additional operational flow conduits or openings. In an embodiment, the flow opening surface area of all operational flow conduits or openings penetrating the inner shroud surface is less than 5% of the total surface area of the inner shroud surface.

In an embodiment, longitudinal mixing vessel axis L is a line of symmetry with respect to the inner shroud curve, except for cutting plane $C_1$ orientations where the cutting plane $C_1$ intersects a penetrating operational flow conduit or opening, and the resulting flow sections are not reflected across the longitudinal mixing vessel axis L. In this embodiment, a second inner shroud curve generated by an intersection between inner shroud surface 208 and the second cutting plane $C_2$ defined earlier is substantially a mirror image of the inner shroud curve. In a further embodiment, the inner shroud curve is a generatrix of inner shroud surface 208 for all cutting plane $C_1$ orientations except those orientations where cutting plane $C_1$ intersects a penetrating operational flow conduit or opening, and inner shroud surface 208 is a surface of revolution about mixing vessel axis L for all areas of inner shroud surface 208 except those areas where the inner shroud curve includes a flow section. In another embodiment, the inner shroud curve can be substantially described by a third mathematical function from fifth point 215 to sixth point 216, where the third mathematical function may be a piece-wise mathematical function, and where the third mathematical function has the variable x and the variable y, and where the third mathematical function treats the variable y as an independent variable and the variable x as a dependent variable.

Outer shroud surface 209 has spatial properties such that an intersection between outer shroud surface 209 and the cutting plane $C_1$ generates an outer shroud curve in the cutting plane $C_1$. The outer shroud curve is between the inner shroud curve and the upper vessel curve, originates at a point on longitudinal mixing vessel axis L, and extends to a point between third point perpendicular 223 and second point perpendicular 222 and between third point parallel 233 and longitudinal mixing vessel axis L. The outer shroud curve does intersect the upper vessel curve or the inner shroud curve at any points.

Similar to the inner shroud curve, when a cutting plane $C_1$ has an orientation with respect to longitudinal mixing vessel axis L such that the cutting plane $C_1$ passes through an operational flow conduit or opening penetrating the outer shroud surface, a portion of the resulting outer shroud curve will be comprised of a flow section extended between two contact points, as earlier discussed. In an embodiment, and similar to the inner shroud surface, the outer shroud surface is penetrated by at least an outer shroud flow opening, as will be discussed, and may be penetrated by additional operational flow conduits or openings. In an embodiment, the flow opening surface area of all operational flow conduits or openings penetrating the outer shroud surface is less than 5% of the total surface area of the outer shroud surface.

In an embodiment, longitudinal mixing vessel axis L is a line of symmetry with respect to the outer shroud curve, except for cutting plane $C_1$ orientations where the cutting plane $C_1$ intersects a penetrating operational flow conduit or opening, and the resulting flow sections are not reflected across the longitudinal mixing vessel axis L. In this embodiment, a second outer shroud curve generated by an intersection between outer shroud surface 209 and the second cutting plane $C_2$ defined earlier is substantially a mirror image of the outer shroud curve. In a further embodiment, the outer shroud curve is a generatrix of outer shroud surface 209 for all cutting plane $C_1$ orientations except those orientations where cutting plane $C_1$ intersects a penetrating operational flow conduit or opening, and outer shroud surface 209 is a surface of revolution about mixing vessel axis L for all areas of outer shroud surface 209 except those areas where the outer shroud curve includes a flow section. In another embodiment, the outer shroud curve can be substantially described by a fourth mathematical function, where the fourth mathematical function may be a piece-wise mathematical function, and where the fourth mathematical function has the variable x and the variable y, and where the fourth mathematical function treats the variable y as an independent variable and the variable x as a dependent variable.

The pulse jet mixing vessel 200 is further comprised of a downcoming flow annulus 210, upper vessel pressurization volume 240, and inner shroud surge volume 242. Downcoming flow annulus 210, upper vessel pressurization volume 240, and inner shroud surge volume 242 are similarly represented by the cross-section resulting from cutting plane $C_1$.

Downcoming flow annulus 210 is between at least a portion of flow surface 205 and at least a portion of outer shroud surface 209, where the portion of outer shroud surface 209 is between third point perpendicular 223 and second point perpendicular 222. Downcoming flow annulus 210 has spatial properties such that an intersection between downcoming flow annulus 210 and the cutting plane $C_1$ generates a line segment from flow surface 205 to outer shroud surface 209, where the line segment is parallel to third point perpendicular 223. As discussed, outer shroud surface 209 extends to a point between third point perpendicular 223 and second point perpendicular 222.

In an embodiment, a single horizontal geometric plane perpendicular to longitudinal mixing vessel axis L passes through all flow surface curves and all outer shroud curves. Here, "all flow surface curves" means any flow surface curve generated by an intersection of flow surface 205 with the cutting plane $C_1$ when cutting plane $C_1$ has any orientation, provided the longitudinal mixing vessel axis L is parallel to or coincident with the y coordinate axis shown, as earlier discussed. Similarly, "all outer shroud curves" means any outer shroud curve generated by an intersection of outer shroud surface 209 with the cutting plane $C_1$ when cutting plane $C_1$ has any orientation, provided the longitudinal mixing vessel axis L is parallel to or coincident with the y coordinate axis shown, as earlier discussed. In this embodiment, downcoming flow annulus 210 is comprised of the area between flow surface 205 and outer shroud surface 209, and coplanar with the single horizontal geometric plane.

In another embodiment, the at least a portion of flow surface 205 and/or the at least a portion of outer shroud surface 209 bounding downcoming flow annulus 210 is comprised of vanes or baffles to impart a swirl in the x-z plane to water expelled from downcoming flow annulus 210.

As discussed, upper vessel pressurization volume 240 is bounded in part by upper vessel surface 206 and outer shroud surface 209. Upper vessel pressurization volume 240 is in fluid communication with the upper vessel flow opening as discussed, and further in fluid communication with downcoming flow annulus 210 by virtue of the placement of outer shroud surface 209 between inner shroud surface 208 and upper vessel surface 206. As a result, when longitudinal mixing vessel L is aligned with a gravity vector and a body of fluid extends from sludge basin surface 202 into downcoming flow annulus 210, a pressure applied through the upper vessel flow opening to upper vessel pressurization volume 240 may act to expel at least a portion of the fluid from downcoming flow annulus 210 toward sludge basin surface 202, subsequently generating an inward radial flow and upwash jet over sludge basin surface 202.

Additionally, as discussed, inner shroud surge volume 242 is bounded in part by inner shroud surface 208, such that a straight line between any point in upper vessel pressurization volume 240 and any point in inner shroud surge volume 242 passes through flow shroud 207. As a result, when longitudinal mixing vessel L is aligned with a gravity vector and a body of fluid extends from sludge basin surface 202 into downcoming flow annulus 210 and into a portion of inner shroud surge volume 242, and when a pressure is applied to upper vessel pressurization volume 240, flow shroud 207 isolates inner shroud surge volume 242 from direct pressurization by upper vessel pressurization volume 240, and fluid expelled from downcoming flow annulus 210 generates a fluid surge into inner shroud surge volume 242.

In a particular embodiment, flow surface 205, outer shroud surface 209, and inner shroud surface 208 form an elliptical, preferably circular closed curve at the intersection of each respective surface with a geometrical plane perpendicular to longitudinal mixing vessel axis L, with the exception of intersections occurring at points on the longitudinal mixing vessel axis L. Such surface geometries can be beneficial in the creation of an inward radial flow and subsequent upwash jet over sludge basin surface 202. In a further embodiment, the flow surface curve of flow surface 205, the outer shroud curve of outer shroud surface 209, and the inner shroud curve of inner shroud surface 208 are each a generatrix of the respective surfaces, such that the respective surfaces are surfaces of revolution about longitudinal mixing vessel axis L.

Figure 3:
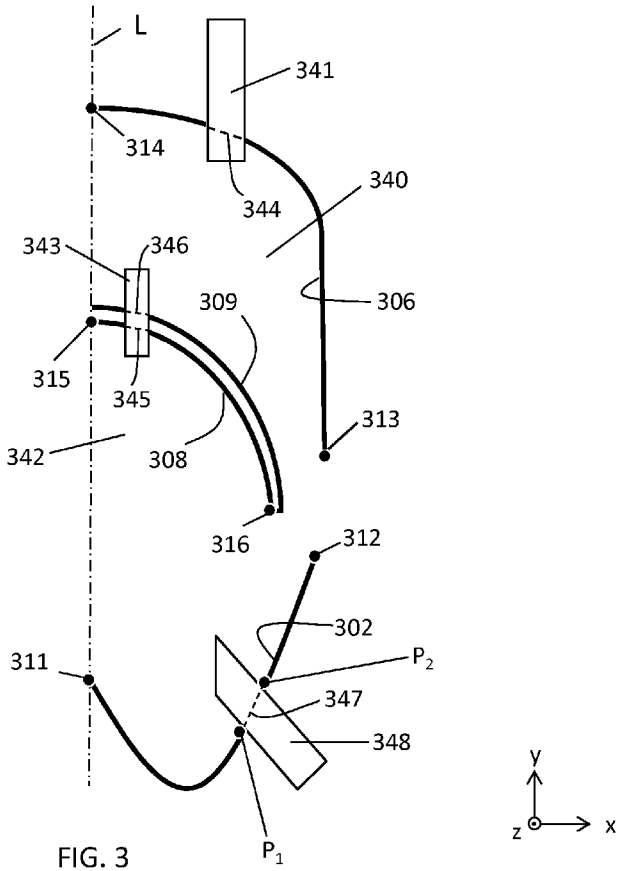
FIG. 3 illustrates spatial relationships between an inner shroud surface, and outer shroud surface, and an upper vessel surface comprised of an inner shroud flow opening, an outer shroud flow opening, and an upper vessel flow opening respectively.

In order to allow pressurization and venting of the upper vessel pressurization volume, and as earlier referenced, the upper vessel surface is comprised of an upper vessel flow opening in fluid communication with the upper vessel pressurization volume and further in fluid communication with an upper vessel gas conduit. This is illustrated at FIG. 3, showing upper vessel gas conduit 341 penetrating upper vessel surface 306, and illustrating an upper vessel curve from third point 313 to fourth point 314 generated by the intersection of a cutting plane $C_1$ (not shown) an upper vessel surface 306, where the cutting plane $C_1$ additionally passes through upper vessel gas conduit 341. This orientation of cutting plane $C_1$ generates upper vessel flow opening 344, where upper vessel opening 344 is shown as a flow section as earlier defined, and where upper vessel opening 344 is in fluid communication with upper vessel pressurization volume 340 and further in fluid communication with upper vessel gas conduit 341. Similarly, in order to allow venting of the inner shroud surge volume, in an embodiment the inner shroud surface is comprised of an inner shroud flow opening in fluid communication with the inner shroud surge volume and further in fluid communication with an outer shroud flow opening, where the outer shroud flow opening is in fluid communication with an inner shroud gas conduit. As illustrated at FIG. 3, inner shroud gas conduit 343 penetrates inner shroud surface 308 and outer shroud surface 309, with an inner shroud curve from fifth point 315 to sixth point 316 and an outer shroud curve between the inner shroud curve and the upper vessel curve. The inner and outer shroud curves are generated by the intersection of a cutting plane $C_1$ (not shown) with the respective inner and outer shroud surfaces, and the cutting plane $C_1$ additionally passes through inner shroud gas conduit 343. This orientation of cutting plane $C_1$ generates inner shroud flow opening 345 and outer shroud flow opening 346, where inner shroud flow opening 345 and outer shroud flow opening 346 are shown as flow sections as earlier defined. As described inner shroud flow opening 345 is in fluid communication with inner shroud surge volume 342 and further in fluid communication with outer shroud flow opening 346, and outer shroud flow opening 346 is in fluid communication with inner shroud gas conduit 343.

Figure 5:
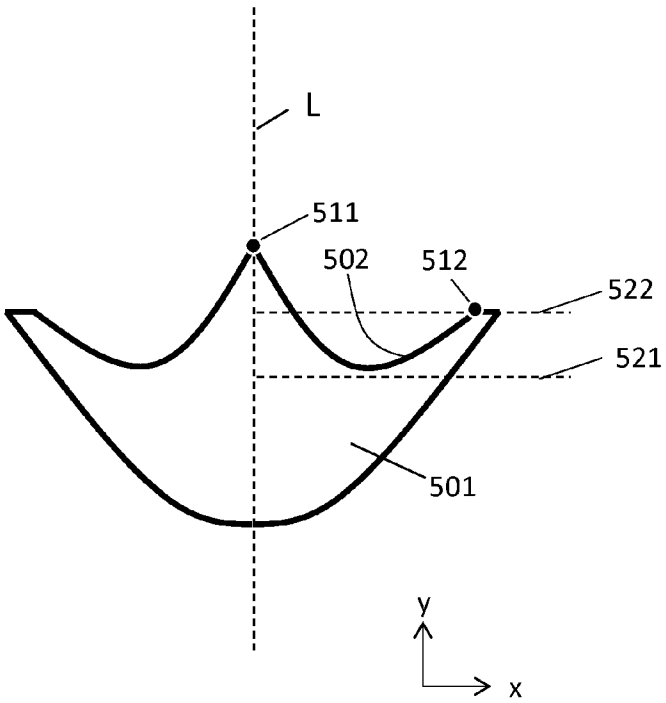
FIG. 5 illustrates a sludge basin in a second specific embodiment of the pulse jet mixing vessel.

In another embodiment, the sludge basin surface is comprised of a central cusp generally in the center of the sludge basin surface, in order to turn an inward radial flow converging toward the center and expand the flow in an upwash jet. Such an embodiment is depicted at FIG. 4, where FIG. 4 depicts a cross-section view of a sludge basin 401 generated by the cutting plane $C_1$ (not shown) defined earlier. As earlier defined, an x-axis originates at first point 411 and is collinear with first point perpendicular 421 and a y-axis originates at first point 411 and is collinear with longitudinal mixing vessel axis L, with the directions of increasingly positive axes values as illustrated. A sludge basin curve extends from first point 411 to second point 421 and results from the intersection between sludge basin surface 402 and cutting plane $C_1$. At FIG. 4, the sludge basin curve crosses first point perpendicular 421 and is comprised of points having a coordinate on the y-axis more negative than both the point of intersection between longitudinal mixing vessel axis L and first point perpendicular 421, and the point of intersection between longitudinal mixing vessel axis L and second point perpendicular 422, based on an origin at the intersection of longitudinal mixing vessel axis L and first point perpendicular 421, as earlier defined. In such cases, the sludge basin curve generates sludge basin surface 402 having a central cusp surrounded by a trough-like region. Such a central cusp region may be beneficial in turning and expanding the inward radial flow into the upwash jet, as well as mitigating the solids hold-up that is often observed in radial and axial impellor stirring tanks. In a further embodiment, illustrated at FIG. 5 and depicting sludge basin 501, sludge basin surface 502, longitudinal mixing vessel axis L, first point 511, second point 512, first point perpendicular 521, and second point perpendicular 522, and based on the origin at first point 511 as earlier defined, a point of intersection between longitudinal mixing vessel axis L and second point perpendicular 522 describes a negative y-coordinate, and the sludge basin curve is comprised of points having a coordinate on the y-axis more negative than both the point of intersection between longitudinal mixing vessel axis L and first point perpendicular 521 and the point of intersection between longitudinal mixing vessel axis L and second point perpendicular 522, such that the central cusp region extends above the sludge basin outer periphery.

Figure 6:
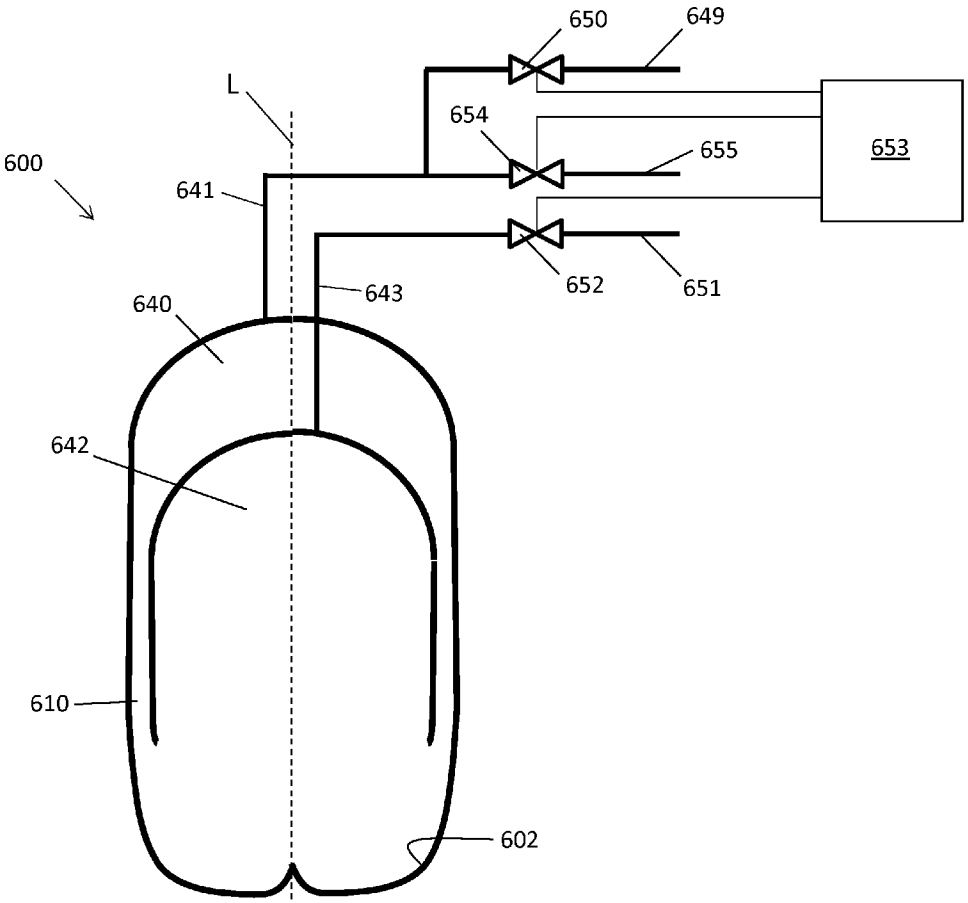
FIG. 6 illustrates specific embodiment of the pulse jet mixing vessel comprised of pressurization and vent valves in fluid communication with the upper vessel pressurization volume and the inner shroud surge volume.

In a further embodiment depicted at FIG. 6, the upper vessel gas conduit 641 of mixing vessel 600 is in fluid communication with upper pressurization volume 640 through the upper vessel flow opening (not shown), and further in fluid communication with a first pressure line 655 comprised of a first pressure valve 654. A flowpath through the first pressure line 655 to the upper vessel gas conduit 641 exists when the first pressure valve 654 is open. Upper vessel gas conduit 641 of mixing vessel 600 is further in fluid communication with a first vent line 649 comprised of a first vent valve 650, and a flowpath through the first vent line 649 to the upper vessel gas conduit 641 exists when the first pressure valve 650 is open. Additionally, inner shroud gas conduit 643 is in fluid communication with inner shroud surge volume 642 through the upper shroud flow opening and the inner shroud flow opening (not shown), and further in fluid communication with second vent line 651 comprised of second vent valve 652, such that a flowpath through second vent line 651 to the inner shroud gas conduit 643 exists when second vent valve 652 is open.

In a particular embodiment, first pressure valve 654, first vent valve 650, and second vent valve 652 are automatically operated valves, and mixing vessel 600 is further comprised of a valve control system 653. Valve control system 653 is in signal communication with first pressure valve 654, first vent valve 650, and second vent valve 652, where the signal communication is electric, electronic, fluid, mechanical, or some other means by which valve control system 653 may direct valve positioning. In this embodiment, valve control system 653 has an upper vessel pressurization mode which maintains first pressure valve 654 and the second vent valve 652 open while the first vent valve 650 is shut, and valve control system 653 has an upper vessel depressurization mode which maintains first vent valve 650 and second vent valve 652 open while first pressure valve 654 is shut. In operation, when the longitudinal mixing vessel axis L of mixing vessel 600 is aligned with a gravity vector, and a body of water extends from sludge basin surface 602 and into downcoming flow annulus 610 and inner shroud surge volume 642, the upper vessel pressurization mode valve control system 653 may be employed to pressurize upper vessel pressurization volume 640 through first pressure valve 654 while venting inner shroud surge volume 642 through first vent valve 650, thereby expelling water from downcoming flow annulus 610, generating an inward radial flow and upwash jet over sludge basin surface 602, and generating inflow into inner shroud surge volume 642. Subsequently, gaseous pressures in upper vessel pressurization volume 640 and inner shroud surge volume 642 may be equalized and water levels returned to equilibrium values using the upper vessel depressurization mode of valve control system 653.

Pressurization of upper pressurization volume 640 may be accomplished through the application of either a gaseous or liquid medium under pressure through first pressure line 655. Similarly, venting of inner shroud gas conduit 643 may be accomplished through the issue of either a gaseous or liquid medium through second vent line 651. Use of incompressible liquid mediums through both first pressure line 655 and second vent line 651 may dictate operations where first pressure line 655 and second vent line 651 are simultaneously open, to avoid over-pressurization of mixing vessel 600.

Thus provided here a pulse jet mixing vessel designed to promote the mixing of solid particles contained in a sludge basin. In operation, a liquid such as water is additionally held by the sludge basin, and the pulse jet mixing vessel achieves particle mixing by periodically generating an inward radial flow from around the outer periphery of the sludge basin and radially inwards toward the center of the sludge basin. The pulse jet mixing vessel is described such that radial stream lines converge inwardly and accelerate as the center of the sludge basin is approached, and subsequently expand in an upwash jet. The vessel achieves the inward radial flow from pressurization of an upper vessel pressurization space, which expels liquid from a downcoming flow annulus and over a flow surface around the sludge basin surface. The expelled water is accommodated by an inner shroud surge volume. Periodic re-suspension and settling in this manner significantly mitigates any tendencies toward particle agglomeration and gas trapping which might occur in an unmixed particle bed. Additionally, the pulse jet mixing vessel accomplishes the mixing through the mechanical relationship of static internal components. The latter advantage is particularly significant when periodic mixing of hazardous particles is required, such as periodic mixing of nuclear waste material of significantly varying particle size and weight.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

What is claimed is:

1. A pulse jet mixing vessel comprised of:

a sludge basin having a sludge basin surface bounded by a sludge basin periphery, where the sludge basin surface is intersected by a mixing vessel longitudinal axis L, where the mixing vessel longitudinal axis L is a geometric line, and where a cutting plane $C_1$ is a geometric closed half-plane having a single defined boundary at the longitudinal mixing vessel axis L, and where an intersection of the sludge basin surface and the cutting plane $C_1$ generates a sludge basin curve, where the sludge basin curve extends from a first point to a second point, where the mixing vessel longitudinal axis L passes through the first point and where the mixing vessel longitudinal axis L is displaced from the second point, and where the first point defines a first point perpendicular, where the first point perpendicular is a geometric line perpendicular to the longitudinal mixing vessel axis L and passing through the first point, and where the second point defines a second point perpendicular and a second point parallel, where the second point perpendicular is a geometric line perpendicular to the longitudinal mixing vessel axis L and passing through the second point, and where the second point parallel is a geometric line parallel to the longitudinal mixing vessel axis L and passing through the second point;

a flow surface, where an intersection of the flow surface and the cutting plane $C_1$ generates a flow surface curve, where the flow surface curve extends from the second point to a third point, where the third point defines a third point perpendicular and a third point parallel, where the third point perpendicular is a geometric line perpendicular to the longitudinal mixing vessel axis L and passing through the third point, and where the third point parallel is a geometric line parallel to the longitudinal mixing vessel axis L and passing through the third point, and where the second point parallel is between the third point parallel and the longitudinal mixing vessel axis L, and where either the second point perpendicular is between the third point perpendicular and the first point perpendicular or the first point perpendicular is between the third point perpendicular and the second point perpendicular, such that the flow surface and the sludge basin are in contact at a sludge basin outer periphery;

an upper vessel surface, where an intersection of the upper vessel surface and the cutting plane $C_1$ generates an upper vessel curve, where the upper vessel curve originates at the third point and extends to a fourth point, where the longitudinal mixing vessel axis L passes through the fourth point, where the fourth point defines a fourth point perpendicular, where the fourth point perpendicular is a geometric line perpendicular to the longitudinal mixing vessel axis L and passing through the fourth point, and where the third point perpendicular is between the fourth point perpendicular and the second point perpendicular, and where the upper vessel curve does not intersect the longitudinal mixing vessel axis L between the third point and the fourth point, such that the upper vessel surface and the flow surface are in contact at a flow surface outer periphery, and where the upper vessel surface is comprised of an upper vessel flow opening;

a flow shroud comprised of, an inner shroud surface, where an intersection of the inner shroud surface and the cutting plane $C_1$ generates an inner shroud curve, where the inner shroud curve originates at a fifth point and extends to a sixth point, where the longitudinal mixing vessel axis L passes through the fifth point, and where the fifth point defines a fifth point perpendicular, where the fifth point perpendicular is a geometric line perpendicular to the longitudinal mixing vessel axis L and passing through the fifth point, and where the fifth point perpendicular is between the fourth point perpendicular and the first point perpendicular, and where the sixth point defines a sixth point perpendicular, where the sixth point perpendicular is a geometric line perpendicular to the longitudinal mixing vessel axis L and passing through the sixth point, and where the sixth point is between the third point perpendicular and the second point perpendicular and between the third point parallel and the longitudinal mixing vessel axis L, and where the inner shroud curve does not intersect the longitudinal mixing vessel axis L between the fifth point and the sixth point and, an outer shroud surface, where an intersection of the outer shroud surface and the cutting plane $C_1$ generates an outer shroud curve, where the outer shroud curve is between the inner shroud curve and the upper vessel curve, and where the outer shroud curve originates at a point on the longitudinal mixing vessel axis L and extends to a point between the third point perpendicular and the second point perpendicular and between the third point parallel and the longitudinal mixing vessel axis L;

a downcoming flow annulus between a portion of the flow surface and a portion of the outer shroud surface; where an intersection of the downcoming flow annulus and the cutting plane $C_1$ generates a geometric line segment from the flow curve to the outer shroud curve, where the geometric line segment is parallel to the third point perpendicular;

an upper vessel pressurization volume between the outer shroud surface and the upper vessel surface, where the upper vessel pressurization volume is in fluid communication with the upper vessel flow opening and where the upper vessel pressurization volume is in fluid communication with the downcoming flow annulus;

an upper vessel gas conduit in fluid communication with the upper vessel flow opening; and an inner shroud surge volume, where the inner shroud surge volume is bounded by some portion of the inner shroud surface.

2. The pulse jet mixing vessel of claim 1 where the outer shroud surface is comprised of an outer shroud flow opening, and where the inner shroud surface is comprised of an inner shroud flow opening, where the outer shroud flow opening is in fluid communication with the inner shroud flow opening, and where the inner shroud flow opening is in fluid communication with the inner shroud surge volume, and where the pulse jet mixing vessel is further comprised of an inner shroud gas conduit in fluid communication with the outer shroud flow opening.

3. The pulse jet mixing vessel of claim 2 where the upper vessel gas conduit is further in fluid communication with a first pressure line comprised of a first pressure valve, such that a flowpath through the first pressure line to the upper vessel gas conduit exists when the first pressure valve is open, and where the upper vessel gas conduit is further in fluid communication with a first vent line comprised of a first vent valve, such that a flowpath through the first vent line to the upper vessel gas conduit exists when the first vent valve is open, and where the inner shroud gas conduit is further in fluid communication with a second vent line comprised of a second vent valve, such that a flowpath through the second vent line to the inner shroud gas conduit exists when the second vent valve is open.

4. The pulse jet mixing vessel of claim 3 where the first pressure valve, the first vent valve, and the second vent valve are automatic valves, and where a valve control system is in signal communication with the first pressure valve, the first vent valve, and the second vent valve, where the valve control system has an upper vessel pressurization mode which maintains the first pressure valve and the second vent valve open while the first vent valve is shut, and where the valve control system has an upper vessel depressurization mode which maintains the first vent valve and the second vent valve open while the first pressure valve is shut.

5. The pulse jet mixing vessel of claim 3 where the first point defines a geometric origin for a coordinate system having an x-axis, a y-axis, and a z-axis, where the x-axis, the y-axis, and the z-axis are geometric lines, and where the x-axis is collinear with the first point perpendicular and where the y-axis is collinear with the longitudinal mixing vessel axis L, and where the x-axis is increasingly positive in a direction from the geometric origin toward the second point and the y-axis is increasingly positive in a direction from the geometric origin to the fifth point and, where the sludge basin curve is substantially described by a first mathematical function from the first point to the second point, where the first mathematical function has a variable x and a variable y, where the variable x describes points on the x-axis and where the variable y describes points on the y-axis, and where the first mathematical function treats the variable x as an independent variable and the variable y as a dependent variable and, where the flow surface curve is substantially described by a second mathematical function from the second point to the third point, where the second mathematical function has the variable x and the variable y, and where the second mathematical function treats the variable y as an independent variable and the variable x as a dependent variable.

6. The pulse jet mixing vessel of claim 5 where a second cutting plane $C_2$ intersects the flow surface, where the second cutting plane $C_2$ is a geometric open half-plane in an x-y plane, where the x-y plane is a geometric plane defined by the x-axis and the y-axis, and where the second cutting plane $C_2$ has longitudinal mixing vessel axis L as a boundary, and where the second cutting plane $C_2$ is displaced from cutting plane $C_1$ by an angle of 180 degrees measured in an x-z plane, where the x-z plane is a geometric plane defined by the x-axis and the z-axis, and where an intersection of the flow surface and the second cutting plane $C_2$ generates a second flow surface curve where the second flow surface curve is substantially described by a reflected second mathematical function in the second cutting plane C2, where the reflected second mathematical function describes a mirror image of the second mathematical function with respect to the longitudinal mixing vessel axis L.

7. The pulse jet mixing vessel of claim 6 where the second cutting plane $C_2$ intersects the sludge basin surface, and where an intersection of the second cutting plane $C_2$ and the sludge basin surface generates a second sludge basin curve where the second sludge basin curve is substantially described by a reflected first mathematical function in the second cutting plane $C_2$, where the reflected first mathematical function describes a mirror image of the first mathematical function with respect to the longitudinal mixing vessel axis L.

8. The pulse jet mixing vessel of claim 7 where, the first mathematical function substantially describes a first generatrix with respect to the longitudinal mixing vessel axis L for all cutting plane $C_1$ orientations, except those cutting plane $C_1$ orientations where the cutting plane $C_1$ intersects a first contact point and a second contact point, and where the sludge basin surface is substantially described as a first surface of revolution generated by rotating the first generatrix about the longitudinal mixing vessel axis L, except for those areas of the sludge basin surface where cutting plane $C_1$ intersects the first contact point and the second contact point, and where the second mathematical function substantially describes a second generatrix with respect to the longitudinal mixing vessel axis L for all cutting plane $C_1$ orientations, except those cutting plane $C_1$ orientations where the cutting plane $C_1$ intersects a third contact point and a fourth contact point, and where the flow surface is substantially described as a second surface of revolution generated by rotating the second generatrix about the longitudinal mixing vessel axis L, except for those areas of the flow surface where cutting plane $C_1$ intersects the third contact point and the fourth contact point.

9. The pulse jet mixing vessel of claim 1 where the mixing vessel axis is substantially parallel to a gravity vector, and where the pulse jet mixer is further comprised of:

a plurality of solid particles contacting the sludge basin surface; and a liquid atop and permeating throughout the plurality of solid particles and extending into the downcoming flow annulus and the inner shroud surge volume.

10. The pulse jet mixing vessel of claim 1 where the first point defines a geometric origin for a coordinate system having a y-axis, where the y-axis is collinear with the longitudinal mixing vessel axis L, and where the y-axis is increasingly positive in a direction from the first point to the fifth point, and where the sludge basin curve crosses the first point perpendicular and is comprised of points having a coordinate on the y-axis more negative than a point of intersection between the longitudinal mixing vessel axis L and the first point perpendicular, and more negative than a point of intersection between longitudinal mixing vessel axis L and the second point perpendicular, such that the sludge basin surface has a central cusp.

11. The pulse jet mixing vessel of claim 10 where the point of intersection between longitudinal mixing vessel axis L and the second point perpendicular defines a y-intercept value of the y-axis, and where the y-intercept value of the y-axis is negative with respect to the geometric origin.

12. The pulse jet mixing vessel of claim 7 where the second mathematical function does not have a point of inflection between the second point and the third point.

13. The pulse jet mixing vessel of claim 7 where the first mathematical function does not have a point of inflection between the first point and the second point.

14. A method of mixing a plurality of solid particles using the pulse jet mixing vessel of claim 1 comprising:

orienting the pulse jet mixing vessel so that the longitudinal mixing vessel axis L is substantially parallel to a gravity vector;

placing the plurality of solid particles on the sludge basin surface, so that the plurality of solid particles is between the sludge basin surface and a load plane, where the load plane is perpendicular to the mixing vessel axis, and where the load plane is between the downcoming flow annulus and the sludge basin outer periphery;

partially filling the pulse jet mixing vessel with a liquid, such that the liquid is atop and permeating throughout the plurality of solid particles and extending into the downcoming flow annulus and the inner shroud surge volume, thereby generating a partially filled pulse jet mixing vessel, where the partially filled pulse jet mixing vessel has an initial pressure in the upper vessel pressurization volume; and pressurizing the upper vessel pressurization volume of the partially filled pulse jet mixing vessel with a pressurizing gas flowing through the upper vessel gas conduit, thereby generating a pressurized pulse jet mixing vessel, and thereby generating an inward radial flow over the plurality of solid particles.

15. The method of claim 14 further comprised of venting the upper vessel pressurization volume of the pressurized pulse jet mixing vessel through the upper vessel gas conduit until the initial pressure is established in the in the upper vessel pressurization volume, thereby re-establishing the partially filled pulse jet mixing vessel.

16. A pulse jet mixing vessel comprised of:

a sludge basin having a sludge basin surface bounded by a sludge basin periphery, where the sludge basin surface is intersected by a mixing vessel longitudinal axis L, where the mixing vessel longitudinal axis L is a geometric line, and where a cutting plane $C_1$ is a closed half-plane having a single defined boundary at the longitudinal mixing vessel axis L, and where an intersection of the sludge basin surface and the cutting plane $C_1$ generates a sludge basin curve, where the sludge basin curve extends from a first point to a second point, where the mixing vessel longitudinal axis L passes through the first point and where the mixing vessel longitudinal axis L is displaced from the second point, and where the first point defines a first point perpendicular, where the first point perpendicular is a line perpendicular to the longitudinal mixing vessel axis L and passing through the first point, and where the second point defines a second point perpendicular and a second point parallel, where the second point perpendicular is a line perpendicular to the longitudinal mixing vessel axis L and passing through the second point, and where the second point parallel is a line parallel to the longitudinal mixing vessel axis L and passing through the second point, and where the first point defines a geometric origin for a coordinate system having an x-axis and a y-axis, where the x-axis is collinear with the first point perpendicular and where the y-axis is collinear with the longitudinal mixing vessel axis L, where the x-axis is increasingly positive in a direction from the geometric origin toward the second point and the y-axis is increasingly positive in a direction from the geometric origin to the fifth point, where the sludge basin curve is substantially described by a first mathematical function from the first point to the second point, where the first mathematical function has a variable x and a variable y, where the variable x describes points on the x-axis and where the variable y describes points on the y-axis, and where the first mathematical function treats the variable x as an independent variable and the variable y as a dependent variable and, where a second cutting plane $C_2$ intersects the sludge basin surface, where the second cutting plane $C_2$ is a geometric open half-plane co-planer with the cutting plane $C_1$, and where the intersection of the second cutting plane $C_2$ and the sludge basin surface is substantially described by a reflected first mathematical function in the second cutting plane $C_2$, where the reflected first mathematical function describes a mirror image of the first mathematical function with respect to the longitudinal mixing vessel axis L;

a flow surface, where an intersection of the flow surface and the cutting plane $C_1$ generates a flow surface curve, where the flow surface curve extends from the second point to a third point, where the third point defines a third point perpendicular and a third point parallel, where the third point perpendicular is a line perpendicular to the longitudinal mixing vessel axis L and passing through the third point, and where the third point parallel is a line parallel to the longitudinal mixing vessel axis L and passing through the third point, and where the second point parallel is between the third point parallel and the longitudinal mixing vessel axis L, and where the first point perpendicular is between the third point perpendicular and the second point perpendicular, such that the flow surface and the sludge basin are in contact at a sludge basin outer periphery, and where the flow surface curve is substantially described by a second mathematical function from the second point to the third point, where the second mathematical function has the variable x and the variable y, and where the second mathematical function treats the variable y as an independent variable and the variable x as a dependent variable, where the intersection of the second cutting plane $C_2$ and the flow surface is substantially described by a reflected second mathematical function in the second cutting plane $C_2$, where the reflected second mathematical function describes a mirror image of the second mathematical function with respect to the longitudinal mixing vessel axis L, and where the first mathematical function generates one or more negative values of the variable y with respect to the geometric origin, and where the one or more negative values of the variable y are more negative than a value of the variable y where the second point perpendicular intersects the longitudinal mixing vessel axis L, such that the sludge basin surface has a central cusp around the first point;

an upper vessel surface, where an intersection of the upper vessel surface and the cutting plane $C_1$ generates an upper vessel curve, where the upper vessel curve originates at the third point and extends to a fourth point, where the longitudinal mixing vessel axis L passes through the fourth point, where the fourth point defines a fourth point perpendicular, where the fourth point perpendicular is a line perpendicular to the longitudinal mixing vessel axis L and passing through the fourth point, and where the third point perpendicular is between the fourth point perpendicular and the second point perpendicular, and where the upper vessel curve does not intersect the longitudinal mixing vessel axis L between the third point and the fourth point, such that the upper vessel surface and the flow surface are in contact at a flow surface outer periphery, and where the upper vessel surface is comprised of an upper vessel flow opening;

a flow shroud comprised of, an inner shroud surface, where an intersection of the inner shroud surface and the cutting plane $C_1$ generates an inner shroud curve, where the inner shroud curve originates at a fifth point and extends to a sixth point, where the longitudinal mixing vessel axis L passes through the fifth point, and where the fifth point defines a fifth point perpendicular, where the fifth point perpendicular is a line perpendicular to the longitudinal mixing vessel axis L and passing through the fifth point, and where the fifth point perpendicular is between the fourth point perpendicular and the first point perpendicular, and where the sixth point defines a sixth point perpendicular, where the sixth point perpendicular is a line perpendicular to the longitudinal mixing vessel axis L and passing through the sixth point, and where the sixth point is between the third point perpendicular and the second point perpendicular and between the third point parallel and the longitudinal mixing vessel axis L, and where the inner shroud curve does not intersect the longitudinal mixing vessel axis L between the fifth point and the sixth point, and where the inner shroud surface is comprised of an inner shroud flow opening and, an outer shroud surface, where an intersection of the outer shroud surface and the cutting plane $C_1$ generates an outer shroud curve, where the outer shroud curve is between the inner shroud curve and the upper vessel curve, and where the outer shroud curve originates at a point on the longitudinal mixing vessel axis L and extends to a point between the third point perpendicular and the second point perpendicular and between the third point parallel and the longitudinal mixing vessel axis L, and where the outer shroud surface is comprised of an outer shroud flow opening, where the outer shroud flow opening is in fluid communication with the inner shroud flow opening;

a downcoming flow annulus between a portion of the flow surface and a portion of the outer shroud surface; where an intersection of the downcoming flow annulus and the cutting plane $C_1$ generates a geometric line segment from the flow curve to the outer shroud curve, where the geometric line segment is parallel to the third point perpendicular;

an upper vessel pressurization volume between the outer shroud surface and the upper vessel surface, where the upper vessel pressurization volume is in fluid communication with the upper vessel flow opening and where the upper vessel pressurization volume is in fluid communication with the downcoming flow annulus;

an upper vessel gas conduit in fluid communication with the upper vessel flow opening, where the upper vessel gas conduit is further in fluid communication with, a first pressure line comprised of a first pressure valve, such that a flowpath through the first pressure line to the upper vessel gas conduit exists when the first pressure valve is open and, a first vent line comprised of a first vent valve, such that a flowpath through the first vent line to the upper vessel gas conduit exists when the first vent valve is open;

an inner shroud surge volume, where the inner shroud surge volume is bounded by some portion of the inner shroud surface, and where the inner shroud surge volume is in fluid communication with the inner shroud flow opening; and an inner shroud gas conduit in fluid communication with the outer shroud flow opening, where the inner shroud gas conduit is further in fluid communication with a second vent line comprised of a second vent valve, such that a flowpath through the second vent line to the inner shroud gas conduit exists when the second vent valve is open.

17. The pulse jet mixing vessel of claim 16 where the first mathematical function substantially describes a first generatrix with respect to the longitudinal mixing vessel axis L for all cutting plane $C_1$ orientations, except those cutting plane $C_1$ orientations where the cutting plane $C_1$ intersects a first contact point and a second contact point, and where the sludge basin surface is substantially described as a first surface of revolution generated by rotating the first generatrix about the longitudinal mixing vessel axis L, except for those areas of the sludge basin surface where cutting plane $C_1$ intersects the first contact point and the second contact point, and where, the second mathematical function substantially describes a second generatrix with respect to the longitudinal mixing vessel axis L for all cutting plane $C_1$ orientations, except those cutting plane $C_1$ orientations where the cutting plane $C_1$ intersects a third contact point and a fourth contact point, and where the flow surface is substantially described as a second surface of revolution generated by rotating the second generatrix about the longitudinal mixing vessel axis L, except for those areas of the flow surface where cutting plane $C_1$ intersects the third contact point and the fourth contact point.

18. The pulse jet mixing vessel of claim 17 where the longitudinal mixing vessel axis L is substantially parallel to a gravity vector, and where the pulse jet mixer is further comprised of:

a plurality of solid particles contacting the sludge basin surface such that the plurality of solid particles is between the sludge basin surface and a load plane, where the load plane is perpendicular to the mixing vessel axis, and where the load plane is between the downcoming flow annulus and the sludge basin outer periphery; and a liquid atop and permeating throughout the plurality of solid particles and extending into the downcoming flow annulus and the inner shroud surge volume, where the liquid has a free surface within the inner shroud surge volume, where the free surface is between the inner shroud flow opening and the sludge basin surface.

19. The pulse jet mixing vessel of claim 18 where the first pressure valve, the first vent valve, and the second vent valve are automatic valves, and where a valve control system is in signal communication with the first pressure valve, the first vent valve, and the second vent valve, where the valve control system has an upper vessel pressurization mode which maintains the first pressure valve and the second vent valve open while the first vent valve is shut, and where the valve control system has an upper vessel depressurization mode which maintains the first vent valve and the second vent valve open while the first pressure valve is shut.

20. A method of mixing a plurality of solid particles using the pulse jet mixing vessel of claim 19 comprising:

establishing fluid communication between the first pressure line and a pressurized gas source, such that a flowpath from the pressurized gas source to the upper vessel gas conduit exists through the first pressure line when the first pressure valve is open;

pressurizing the upper vessel pressurization volume of the pulse jet mixing vessel by placing the valve control system in the upper vessel pressurization mode, thereby generating a pressurized pulse jet mixing vessel, and thereby generating an inward radial flow over the plurality of solid particles;

venting the upper vessel pressurization volume of the pressurized pulse jet mixing vessel by placing the valve control system in the upper vessel depressurization mode.

* * * * *